US006530384B1

(12) United States Patent
Meyers et al.

(10) Patent No.: US 6,530,384 B1
(45) Date of Patent: Mar. 11, 2003

(54) POTENTIATED DISINFECTANT CLEANING SOLUTIONS AND METHODS OF USE

(75) Inventors: Stephen J. Meyers, Williamsville, NY (US); Lyn M. Dyster, Lewiston, NY (US)

(73) Assignee: Albert E. Nemmer, Clarence, NY (US)

( * ) Notice: Subject to any disclaimer, the term of this patent is extended or adjusted under 35 U.S.C. 154(b) by 3 days.

(21) Appl. No.: 09/918,382

(22) Filed: Jul. 30, 2001

Related U.S. Application Data

(63) Continuation-in-part of application No. 08/584,942, filed on Jan. 16, 1996, now abandoned.

(51) Int. Cl.[7] ..... B08B 3/04; C11D 1/62; C11D 3/39; C11D 3/48

(52) U.S. Cl. ..... 134/25.2; 134/25.4; 134/42; 510/199; 510/319; 510/384; 510/391; 510/423; 510/433; 510/504; 510/240

(58) Field of Search ..... 510/199, 319, 510/384, 391, 423, 433, 504, 240; 134/25.2, 25.4, 42

(56) References Cited

U.S. PATENT DOCUMENTS 2,917,428 A * 12/1959 Hitzman ..... 167/22
4,311,598 A * 1/1982 Verachtert ..... 210/757
4,397,757 A * 8/1983 Bright et al. ..... 252/186.41
4,444,790 A * 4/1984 Green et al. ..... 424/329
4,557,898 A * 12/1985 Greene et al. ..... 422/28
4,847,089 A * 7/1989 Kramer et al. ..... 424/405
4,850,729 A * 7/1989 Kramer et al. ..... 401/183
4,941,989 A * 7/1990 Kramer et al. ..... 252/102
5,258,409 A * 11/1993 Gay ..... 514/642
5,259,848 A * 11/1993 Terry et al. ..... 8/111
5,320,805 A * 6/1994 Kramer et al. ..... 422/28
5,348,556 A * 9/1994 Minns et al. ..... 8/137
5,373,025 A * 12/1994 Gay ..... 514/642

* cited by examiner

*Primary Examiner*—Yogendra N. Gupta
*Assistant Examiner*—Brian P Mruk
(74) *Attorney, Agent, or Firm*—Howard M. Ellis

(57) ABSTRACT

Potentiated compositions and methods for disinfection of porous surfaces, such as ceiling tiles contaminated with bacteria and fungi permits renewal without requiring replacement tiles. The compositions, preferably water clear aqueous solutions, comprise synergistic combination of quaternary ammonium compound, a surfactant, and a hydrogen peroxide solution at very low concentrations than otherwise required if used alone. The active components are present in minimal proportional ranges sufficient to achieve a virtual 100 percent kill of bacteria and fungi present on surfaces.

20 Claims, No Drawings

POTENTIATED DISINFECTANT CLEANING SOLUTIONS AND METHODS OF USE

CROSS REFERENCE TO RELATED APPLICATION

This application is a continuation-in-part of application Ser. No. 08/584,942 abandoned, filed Jan. 16, 1996.

TECHNICAL FIELD

This invention relates to novel chemical formulations useful for simultaneous cleaning and disinfecting surfaces, especially porous surfaces, such as acoustic ceiling tiles in hospitals and other medical and dental facilities, etc., where at least a virtual 100% kill rate of bacteria and fungi is desired. More particularly, the present invention relates to potentiated disinfectant cleaning solutions comprising as active working ingredients a quaternary ammonium compound, a compatible surfactant other than a quaternary ammonium compound, such as a non-ionic or amphoteric surface active agent, and a solution of hydrogen peroxide. The active ingredients are present in minimal proportional ranges sufficient to achieve a virtual 100 percent kill of the microbes, e.g., bacteria and fungi present.

Furthermore, the invention relates to processes of disinfecting contaminated surfaces/substrates with the foregoing anti-microbial cleaning solutions wherein virtually 100% of bacteria and fungi are destroyed, resulting in the restoration and extension of the useful life of the treated surfaces/substrates.

BACKGROUND OF THE INVENTION

Disinfection of building interiors and other surfaces is a major concern in hospitals and other health care facilities where the presence of unwanted bacteria may be detrimental to the health of patients and workers. Health care facilities are not alone in their concern for elimination of harmful bacteria and fungi. Surfaces harboring undesirable microorganisms can pose a health threat in schools, office buildings and homes. For that reason, it is highly desirable to disinfect all surfaces in such facilities to remove as many harmful organisms as possible.

A common building surface of particular concern is ceiling tiles. Because of their porosity, ceiling tiles are particularly susceptible to harboring harmful bacteria and other microorganisms, and they are especially difficult to clean. In many instances, cleaning and disinfecting the tiles involves removing the tiles and exposing them to time consuming treatments with bactericidal agents. Even after such treatment significant amounts of bacteria and fungi can remain in the tiles and replicate.

Cleaning compositions exist which can achieve high kill rates of some harmful microorganisms. However, these compositions tend to have relatively high concentrations of toxic ingredients. Safe application of these compositions often requires special handling procedures and precautions. These can include use of protective equipment, such as safety goggles, gloves, coveralls, face masks, and the like. In many cases, additional ventilation of the space being disinfected is essential during and after application of these compositions.

Hydrogen peroxide ($H_2O_2$) has been proposed as a bactericide and has been used for many years as a topical antiseptic, especially as a 3% aqueous solution. Addition of ferric or cupric ions, potassium dichromate, cobaltous sulfate, or manganous sulfate is known to enhance the bactericidal action of $H_2O_2$.

However, $H_2O_2$ suffers from the disadvantage that by itself it is relatively inefficient and is not a potent fungicide. Further, $H_2O_2$ especially at higher concentrations is irritating to the skin, eyes, and mucous membranes. Health and safety hazards associated with the use of solutions containing $H_2O_2$ increase as the concentration of $H_2O_2$ in the solutions increases. It is therefore desirable that disinfecting solutions contain the lowest possible concentrations of $H_2O_2$.

Processes and compositions for the disinfection of aqueous media employing hydrogen peroxide are disclosed in U.S. Pat. No. 4,311,598 to Verachtert. The disinfectant comprises a combination of hydrogen peroxide, a soluble copper salt, such as copper sulphate and an autoxisable reducing agent such as ascorbic acid or sodium sulphite. While these compositions appear to be relatively effective in killing bacteria in some aqueous solutions, they are not efficacious fungicides. Nor has their efficacy on surfaces been demonstrated.

Quaternary ammonium compounds, usually tetrasubstituted ammonium salts, have been reported for use as bacteristats, bactericides, and algaecides. Those used as bacteristats and bactericides have required relatively high levels to be effective or have required prolonged contact times.

Examples of references describing the use of quaternary ammonium compounds include U.S. Pat. No. 5,373,025 to Gay which discloses a sanitizer for swimming pools, spas and hot tubs comprising a quaternary ammonium compound and a copper ion source.

Examples of publications disclosing sanitizers combining peroxides with quaternary ammonium compounds include U.S. Pat. No. 5,348,556 to Minns et al. This patent discloses an aqueous composition which cleans and sanitizes carpets, and the like. In general, the compositions contain peroxide in concentrations of about 3% to about 30%, in combination with a volatile ammoniated substance, including tetra butyl ammonium hydroxide, in an amount of about 0.1% to 5%. However, the Minns et al patent does not disclose a fungicide, nor are the compositions disclosed as providing at least a virtual 100% kill rate of bacteria.

U.S. Pat. No. 4,397,757 to Bright et al discloses bleaching and detergent compositions containing hydrogen peroxide and quaternary ammonium activators. While the compositions of the Bright et al patent are disclosed to be effective as whiteners and cleaners, such compositions are not intended to provide high kill rates of bacteria and fungi.

Other patents of interest employing quaternary ammonium compounds are U.S. Pat. Nos. 4,941,989 and 5,320,805 both to Kramer et al. Each of the Kramer patents discloses a variety of compositions, all characterized as prepared from alkaline water soluble "per salts", preferably from 10 to 90% by weight sodium percarbonate ($2Na_2CO_3.3H_2O_2$); from a fraction of a percent to about 30% by weight of a positively charged phase transfer agent, preferably a quaternary ammonium salt, and a surfactant within a range of about 0.25 to 20% by weight.

According to the Kramer et al patents, the alkaline per salt is dissolved in an aqueous solution of the positively charged quaternary ammonium phase transfer agent to extract a proton from the per salt. According to the express teachings of Kramer et al, in order for the reaction to occur the aqueous medium is required to have a rather high pH of at least 9.5. This high pH is readily attained because per salts, such as sodium percarbonate also yield alkaline sodium carbonate when in water. Such aqueous compositions will typically have pHs in the range of 10 to 11, or more.

While such solutions, according to the Kramer patents, yield hydroperoxide ions, $HO_2^-$, to become associated with the positively charged quarternary ammonium ion, it was found that any residual molecular hydrogen peroxide which might otherwise remain in the alkaline solution rapidly breaks down as observed by the prompt release of oxygen bubbles.

Accordingly, the instability of hydrogen peroxide when present in alkaline media severally limits shelf-life and the ability to premix antimicrobial solutions with per salts, like sodium percarbonate (Kramer at al), and be able to store and ship product, and maintain high antimicrobial activity.

As previously pointed out, the patents of Kramer et al disclose various types of compositions prepared with per salts, etc., including creams, bulk powders, tablets, soaps and also solutions. While sodium percarbonate has a listed solubility in water of about 120 gm/L at 20° C. the preparation of true solutions, i.e., liquid having a single phase, according to the protocols of the Kramer et al patents by dissolving the granular/solid sodium percarbonate salt in the liquid components were found not to yield true solutions, i.e. liquid with a single phase. Instead, the liquid yields two distinct phases possibly resulting from incompatibilities with other active ingredients in solution, such as the quaternary ammonium compound or surfactant. Hence, these inventors found in attempting to replicate the working examples in accordance with the disclosures of the Kramer et al patents relating to the preparation of solutions with sodium percarbonate, an alkaline pH of at least 10 to 11 resulted in the evolution of oxygen gas, demonstrating the lack of stability and shelf-life, and rapid dissipation of important antimicrobial activity through premature evolution of oxygen bubbles. Furthermore, the liquid compositions of Kramer et al resulted in multi-phase compositions, rather than true single phase solutions when prepared according to the protocols of the working examples.

Accordingly, a need remains for dual action anti-bacterial and anti-fungal solutions which can be readily prepared as true solutions and which are storage stable retaining substantially all their anti-microbial activity even after prolonged periods of storage, and are capable of achieving at least a virtual 100% kill rate for both bacteria and fungi while requiring very low concentrations of potentially corrosive, toxic and other active ingredients. Such disinfectant cleaning solutions should be effective in the restoration of treated surfaces/substrates as to extend their useful lives and avoid the need for more costly replacements.

SUMMARY OF THE INVENTION

For purposes of this invention, the terms and expressions below appearing in the specification and claims are intended to have the following meanings:

"Disinfectant" refers to any antimicrobial agent which destroys or irreversibly inactivates infectious or other undesirable bacteria, pathogenic fungi on surfaces or inanimate objects.

"Surfactant" (surface-active-agent) is generally intended to refer to a substance which when dissolved in water or other aqueous solution reduces the surface or interfacial tension between it and another substance or material. However, for purposes of this invention, the term—surfactant—as appearing in the specification and claims is intended to specifically include only nonionic surfactants, amphoteric surfactants and cationic surfactants other than quaternary ammonium compounds and salts thereof. Surfactants for purposes of this invention do not include negatively charged anionic type surface active agents or other compounds which are incompatible in solution with the disinfecting quaternary ammonium compound component of the potentiated disinfectant cleaning solutions of this invention. In this connection, amphoteric surfactants is intended to include those surface active agents which exhibit cationic properties when in solutions of this invention.

"Virtual 100% kill" refers to an effective kill of essentially all target organisms existing in a sample, material or substrate to be disinfected and cleaned. This expression is hereby distinguished from the expression "actual 100% kill", which is taken to mean a kill of precisely 100% of target organisms. Hence, the expression—virtual 100% kill—means the destruction of slightly less than 100% of the target microbes, i.e., between 96% and 100%.

"Storage stable" as appearing in the specification and claims is intended to mean the disinfectant cleaning solutions have good shelf life, remain as solutions and retain the substantial part of their original antimicrobial properties after preparation of the solutions and during extended periods of storage in sealed polymeric containers under ambient temperature conditions.

"Working solution" as appearing in the claims and specification is intended to mean the prepared solution in ready-to-use format and concentration for applying to a surface for disinfection and cleaning.

In accordance with the invention a principal object is to provide for storage stable potentiated disinfectant cleaning compositions in the form of aqueous solutions. "Solutions" as appearing in the specification and claims is intended to mean a single phase liquid. This excludes multiphase systems or mixtures, such as dispersions of solid particles suspended in a liquid phase, or precipitated solids which separate out of a liquid phase, or mixtures of immiscible liquids, such as emulsions containing separate phases or layers.

The active ingredients of the aqueous working solutions comprise a disinfectant quaternary ammonium compound or salt thereof; a surfactant as previously defined and hydrogen peroxide introduced into the working solution as a solution of hydrogen peroxide. Use of alkaline per salts, such as sodium percarbonate should be avoided because their highly alkaline pH facilitates the decomposition of hydrogen peroxide in solution shortening shelf life, dissipates antimicrobial activity, and for other reasons discussed supra.

The above active ingredients are present in minimal proportional ranges sufficient to achieve at least a virtual 100 percent kill of bacteria and fungi present. Unexpectedly, it was found the combined effect of the foregoing active ingredients together in the same composition effectively enhances both the fungicidal and bactericidal activity beyond the mere additive effects of the individual ingredients used alone or in sub-combinations. Advantageously, the potentiated activity of the disinfectant cleaning solutions of the invention allows for a significant reduction in the proportional ranges of active ingredients otherwise required in such disinfectant compositions. The very low concentration of active ingredients in the working solutions of the invention minimizes the risks of chemical contamination to the environment and hazards of toxicity to personnel applying the compositions, importantly without incurring trade-offs in cleaning and disinfecting performance.

The storage stable aqueous solutions of the invention also have a pH which maintains the shelf-life stability of the working solutions, and in particular, maintains the stability of the hydrogen peroxide, so oxygen is not readily released from solution. The preferred pH for maintaining shelf life stability is approximately a neutral pH of about 7, however, the pH may be somewhat acidic, i.e., in the range of 6 to 7. Likewise, the solutions may also be mildly alkaline, generally in the range of 7 to 7.5, but preferably not above 8. Thus, the pH is generally in the range of about 6 to 8, but more preferably, in the range of about 6.5 to about 7.5.

The quaternary ammonium compounds can be tetrasubstituted ammonium salts, such as a halide salt, e.g., chloride, bromide. However, practically any quaternary ammonium compound possessing some antimicrobial activity, and particularly antibacterial, antifungal and even some antiviral activity, and which is soluble and stable in aqueous solutions with the other active ingredients is suitable.

As previously stated, the surfactant component is intended to include most non-ionic, amphoteric and cationic types. The cationic type can include surfactants other than quaternary ammonium compounds and which are suitable for use in an aqueous system. Surprisingly, the inventors discovered the surfactant ingredient contributes to the potentiated disinfecting action of the compositions, but in addition, imparts detergency properties to the compositions by aiding in dispersing of unwanted foreign matter, such as soil particulates, grease, etc., from the substrate being cleaned.

The hydrogen peroxide ingredient is selected from solutions of hydrogen peroxide, usually from concentrated solutions, like 30%, 40%, or more by weight.

As previously stated, it is an object of the invention to provide for storage stable, potentiated disinfectant cleaning solutions. Working solutions comprise minimal concentrations of the above ingredients to achieve at least a virtual 100% kill of microorganisms. More specifically, the working solutions contain quaternary ammonium compound in an amount ranging from about 0.05% to about 5.0%; surfactant or detergent in an amount from about 0.05% to about 3.5%, and hydrogen peroxide solution in an amount sufficient to provide a working strength solution from about 0.05% to about 10%. Unless stated otherwise, the concentrations of ingredients are based on percent-by-weight.

It is yet a further object of the invention to provide disinfectant cleaning solutions having potentiated bactericidal and fungicidal properties, wherein the working strength solution comprises at least 0.05% by weight hydrogen peroxide prepared from a solution of hydrogen peroxide; as little as about 500 ppm of a dialkyl dimethyl ammonium chloride, N-alkyl dimethyl benzyl ammonium chloride, and from about 0.05% percent to about 3.0% percent of a detergent composition comprising a non-ionic surfactant. The dialkyl dimethyl ammonium chloride is preferably didecyl dimethyl ammonium chloride.

It is still a further object of the invention to provide methods for simultaneously disinfecting and cleaning a surface or substrate so it is free or virtually free of bacteria and fungi, and cleaned of unwanted foreign matter. The method comprises the steps of:

(i) providing a storage stable working disinfectant and cleaning solution comprising a quaternary ammonium compound in an amount ranging from about 0.05% to about 5.0%; surfactant or detergent in an amount from about 0.05% to about 3.5%, and hydrogen peroxide solution in an amount sufficient to provide a working solution with about 0.05 and about 10% of the hydrogen peroxide, and the balance water;

(ii) contacting a surface with a sterilizing amount of the disinfectant cleaning solution of step(i) to provide a surface which is free or virtually free of bacteria and fungi, i.e., at least a virtual 100% kill of bacteria and fungi, and other unwanted foreign matter, such as soil particulates.

The method may be utilized in cleaning, disinfecting and restoring the original appearance to a wide variety of porous and non-porous substrates, particularly surfaces such as brick; cinder block; including wood, plastic and aluminum type siding; fiberglass; concrete and ceiling tiles of various types, to name but a few. The disinfectant cleaning solutions are especially noteworthy in their ability to penetrate, especially porous surfaces, and thereby effectively sterilize the entire substrate, especially in the case of wood based siding products, and acoustical ceiling tiles.

DESCRIPTION OF THE PREFERRED EMBODIMENTS

In accordance with the present invention, disinfectant cleaning solutions have been discovered which effectively achieve at least a virtual 100% disinfection and cleaning of surfaces while minimizing the required concentrations of potentially hazardous or toxic ingredients. Table 1 below provides a representative list of bacteria and fungi against which the formulations of the invention were tested for efficacy. As can be seen from the kill rates shown for each organism the formulations of the invention have achieved at least a virtual 100% kill of practically all bacteria and fungi tested, and in many instances achieved an actual 100% kill.

TABLE 1

| Organism | Class | % Kill |
|---|---|---|
| Bacillus spp. | Bacteria | 100 |
| *Serratia marcescens* | Bacteria | 100 |
| Staphylococcus spp. | Bacteria | 100 |
| *Pasteurella multicoda* | Bacteria | 100 |
| Proteus spp. | Bacteria | 100 |
| Pseudomonas spp. | Bacteria | 100 |
| *Aspergillus niger* | Fungi | 98 |
| Ulocladium | Fungi | 100 |
| Fusarium | Fungi | 98 |
| *Aspergillus glaucus* | Fungi | 98 |
| *Aspergillus flavus* | Fungi | 98 |
| Penicillium | Fungi | 100 |
| Trichophyton | Fungi | 100 |
| *Aspergillus versicolor* | Fungi | 95 |
| Stachybotrys | Fungi | 99 |
| *Trichophyton mentagrophytes* | Fungi | 100 |
| *Acremonioum cephalosporum* | Fungi | 100 |
| Phoma | Fungi | 100 |

The water clear potentiated disinfectant cleaning formulations are prepared from a solution of hydrogen peroxide in a sufficient amount to provide a hydrogen peroxide concentration from about 0.05% by weight; a surfactant in an amount from about 0.05%; a quaternary ammonium compound such as didecyl dimethyl ammonium chloride, N-alkyl ($C_{12}$) dimethyl benzyl ammonium chloride, etc., in an amount from about 0.05% and the balance water.

The hydrogen peroxide component of the solution is the oxidant, and is derived from a solutions of hydrogen peroxide, 30 to 40 percent aqueous solutions, for example.

The surfactant may include most commercially available compounds from the classes of non-ionic and amphoteric types, and also includes cationic type surfactants other than quaternary ammonium compounds. Non-ionic types are especially preferred. One particularly suitable non-ionic surfactant, an alkyl phenol ethoxylate is available from the Buffalo Soap Company under product name 201C, and comprises nonyl phenol ethoxylate as the principal ingredient. Other useful non-ionic surfactants include the ethylene oxide/propylene oxide copolymers, and more specifically the ethylene diamine reacted block copolymers available from BASF under the trademarks Tetronic and Pluronic. Other nonionic types include the ethoxylated fatty alcohols containing from 11 to 15 carbon atoms and from 3 to 40 moles of ethylene oxide available from Union Carbide under the trademark Tergitol, and so on. Examples of amphoteric surfactants which are useful as detergents are the imidazolinium derivatives prepared from 2-alkyl-1-(2-hydroxyethyl)-2-imidazolines and sodium chloracetate. This class of surfactants is commercially available from Rhone-Poulenc under such trademarks as Miranol. Also included in this group of amphoteric surfactants are the betaines or sultaines available from Lonza, Inc., under the trademark Lonzaine.

Useful, cationic surfactants other than quaternary ammonium compounds are the polyoxyethylated cationic surfactants. Also included are the amines consisting of aliphatic and mono-, di- and polyamines derived from fatty and rosin acids. They include mainly primary, secondary and tertiary monoamines with $C_{18}$ alkyl and alkenyl chains. They are commercially available as acetates, oleates, and so on. Other useful cationic surfactants other than quaternary ammonium compounds include the oxygen-containing amines. This group includes amine oxides, ethoxylated alkylamines, 1-(2-hydroxyethyl)-2-imidazolines, and alkoxylates of ethylenediamine.

Most any quaternary ammonium compound, and especially those known to possess some biocidal activity may be used in the formulations of the invention. In one particularly preferred embodiment a tetrasubstituted ammonium salt, such as a quaternary ammonium halide salt can be utilized. The quaternary ammonium halide salt may be selected from the group consisting of a dialkyl-dimethyl ammonium chloride, an alkyl dimethyl benzyl ammonium chloride, an alkyl dimethyl ethyl benzyl ammonium chloride, and mixtures thereof. In one especially preferred embodiment of the invention, the dialkyl dimethyl ammonium chloride salt is didecyl dimethyl ammonium chloride (DDAC) and n-alkyl ($C_{12}$,$C_{14}$,$C_{16}$) dimethyl benzyl ammonium chloride available under the trademark Uniquat® QAC from Lonza, Inc. Fair Lawn, N.J.

The formulations of the invention may be provided in ready-to-apply, i.e., working solutions diluted with water, or alternatively, may be furnished as concentrates to be later diluted with water at the site to be decontaminated.

The solutions can be applied to a surface, such as ceiling tile by first placing the solution into a reservoir on a spray applicator machine. The suggested temperature of the solution during treatment is typically between about 20° C. and about 60° C. The solution may then be applied to ceiling tiles, for instance, at a consistent pressure of about 110 psi using a fan nozzle tip having a tip angle of about 25 degrees. The tip is preferably held at a distance of about 8 inches to about 12 inches from the surface to be disinfected.

The recommended water temperature, pressure consistency, angle of the tip and application distance are optimized to properly allow penetration of the surface while preserving important attributes of the ceiling tiles, such as acoustic properties, flame retardant and esthetic features.

As previously mentioned, the solutions and methods of cleaning according to the invention are especially desirable in the renewal of ceiling tiles, such as fiberglass type since they can be disinfected, sanitized and simultaneously cleaned in the same treatment process by the removal of dust and other undesirable particulate matter deposited therein as airborne dirt, as well as grease, bacteria, fungi, and so on, which normally builds up over a period of time due to closed, artificial environments and constant recirculation of air through forced air ventilation heating and cooling systems of buildings. Acoustical ceiling tiles, for example, can function as repositories of potentially toxic bacteria, fungi and even viruses which can contaminate and reinfect the working environment of office buildings, schools, hospitals, etc. Heretofore, the only alternative was to replace literally thousands of ceiling tiles of hospitals which have become soiled and infected with microbes with totally new tiles at very significant cost. Hence, the solutions and methods of the invention are especially advantageous in providing a more economic alternative to the costly option of installing new ceiling tiles.

The following specific examples demonstrate the invention, however, it is to be understood they are for illustrative purposes only and do not purport to be wholly definitive as to conditions and scope.

EXAMPLES

In order to illustrate the potentiated effect of the solutions of the invention a series of tests was conducted wherein each of the ingredients was tested singly and in various combinations with other ingredients at increasing levels of concentration. The results demonstrate that the disinfectant cleaning solutions of the invention achieve superior kill rates to those formulations used heretofore, and with higher rates of kill than would otherwise be expected based on test results of individual ingredients of the solution.

Bactericidal Test Protocol

Tests were performed using *E. Coli* (TB1 strain). The protocol consisted of growing the bacteria to stationary phase by incubating at 37° C. with agitation overnight. Tryptic Soy, a nutrient rich source, was used as the growth media. Tryptic Soy agar plates were used to simulate disinfectant efficacy on a porous surface. To this end, 0.2 ml of a disinfectant test solution was spread plated to uniformly cover the agar surface. The plates were allowed to set at room temperature (25° C.) in order for the test solution to be absorbed into the media.

For each test, a 0.1 ml aliquot of the stationary phase *E. Coli* culture was spread plated onto the agar. Dual controls were used consisting of a positive control for testing the viability of the organism used in the experiments wherein 0.1 ml of the *E. Coli* culture was spread plated onto untreated plates, i.e. plates not having any disinfectant test solution. A negative second control was also used for testing the sterility of the media used in the experiments wherein disinfectant test solution treated plates were incubated in the absence of *E. Coil.*

In each case, test and control plates were incubated for 18 to 24 hours at 37° C., the optimal temperature for bacterial growth.

Following incubation, test plates were scored by comparison to control plates. The positive control plates were scored as 100% growth or 0% kill. Test plates were scored relative to these values, and the data recorded.

Fungicidal Test Protocol

Penicillium spp. was grown to confluence by incubating cultures at 25° C. on Sabaroud dextrose media which was chosen as a typical nutrient rich source for supporting fungal growth. Sabaroud dextrose agar plates also simulate disinfectant efficacy on a porous surface. For each test, 0.2 ml of the disinfectant test solution was spread plated to uniformly cover the agar surface. The plates were allowed to set at room temperature (25° C.) in order for the test solution to be absorbed into the media.

A 0.1 ml aliquot of the fungal spores resuspended in the dextrose broth was spread plated onto the agar surface. Dual controls were also used, consisting first of a positive control for testing the viability of the organism used in the experiments wherein 0.1 ml of the penicillium culture was spread plated onto untreated plates, i.e., plates not have disinfectant test solution. A negative control was also used for testing the sterility of the media used in the experiments. This control consisted of test plates treated with disinfectant test solution which were incubated in the absence of Penicillium.

In each case, test and control plates were incubated for 5 days at 25° C., the optimal temperature for penicillium growth.

Following incubation, test plates were test scored by direct comparison to control plates. The positive control plates were scored as 100% or 0% kill. Test plates were scored relative to these values, and the data recorded.

Peroxide Alone

A first series of tests was conducted using solutions of $H_2O_2$ and water. Solutions having increasing concentrations of $H_2O_2$ were prepared and efficacy of the solution against bacteria and fungi was tested according to the protocols described above. Each test was repeated twice at every concentration level of $H_2O_2$ tested. The results are shown in Table 2, below.

TABLE 2

| Component: % $H_2O_2$ | Anti-Bacterial Activity (% Kill) | Anti-Fungal Activity (% Kill) |
|---|---|---|
| 0 | 0 | 0 |
| 2.5 | 70, 70, 50 | 20, 20 |
| 5.0 | 75, 80, 50 | 60, 70 |
| 7.5 | 85, 70, 75 | 95, 70 |
| 10 | 90, 100, 75 | 80, 90 |
| 15 | 95, 100, 75 | 95, 90 |
| 20 | 95, 100, 80 | 80, 95 |
| 25 | 90, 95, 80 | 80, 95 |
| 30 | 95, 100, 90 | 80, 90 |
| 35 | 100, 100, 80 | 95, 99 |

The test data indicate that high kill rates (>95%) of bacteria were not achieved until solutions containing $H_2O_2$ only were applied at high concentrations in the range of 30 to 35%. Similarly, high kill rates of fungi (>95%) were not achieved until $H_2O_2$ concentrations of 35% were applied. Thus, kill levels of both bacteria and fungi did not approach the virtual 100% level until $H_2O_2$ concentrations of at least 35% were applied.

Surfactant Alone

A second series of tests was conducted using solutions of a non-ionic surfactant. The specific non-ionic surfactant used in the tests was polyoxyethylene fatty acid esters formula $RCOO(CH_2CH_2O)NH$, wherein R is a long chained alkyl group. This surfactant is available from the Buffalo Soap Corporation under the product designation of Detergent #201C.

Multiple solutions having increasing concentrations of surfactant were prepared. Efficacy of the solutions against bacteria and fungi was tested according to the protocols described above. Each solution was tested twice at each concentration of surfactant. The results are shown in Table 3, below.

TABLE 3

| Component % 201C | Anti-Bacterial Activity (% Kill) | Anti-Fungal Activity (% Kill) |
|---|---|---|
| 0 | 0 | 0 |
| 2.5 | 0, 0 | 0, 0 |
| 5.0 | 0, 0 | 0, 0 |
| 7.5 | 0, 0 | 0, 0 |
| 10 | 0, 0 | 0, 0 |
| 15 | 0, 0 | 0, 0 |
| 20 | 15, 15 | 0, 0 |
| 25 | 25, 20 | 0, 0 |
| 30 | 35, 25 | 0, 20 |
| 35 | 40, 30 | 0, 20 |

As the results in Table 3 indicate, solutions containing surfactant alone at concentrations even as high as 35% failed to achieve significant kill rates of either bacteria or fungi.

Quaternary Ammonium Compounds

Four commercially available quaternary ammonium compounds were tested individually to determine the efficacy of each against bacteria and fungi. The specific quaternary ammonium compounds tested were: BTC® 885, dialkyl dimethyl ammonium chloride and n-alkyl dimethyl benzyl ammonium chloride; BTC 1010, didecyl dimethyl ammonium chloride; BTC 2125, n-alkyl dimethyl benzyl ammonium chloride and n-alkyl dimethyl ethyl benzyl ammonium chloride and BTC 835, an n-alkyl dimethyl benzyl ammonium chloride. These compounds are available from the Stepan Company of Northfield, Ill.

Quat. A Alone

A series of tests was conducted according to the protocols above using a preparation comprising the quaternary ammonium compound, dialkyl dimethyl ammonium chloride and n-alkyl dimethyl benzyl ammonium chloride, available under the trade name BTC 885, hereinafter referred to as Quat. A. BTC 885 comprises the following active ingredients: n-Alkyl (50% $C_{14}$, 40% $C_{12}$, 10% $C_{16}$) dimethyl benzyl ammonium chloride in the proportion of 20%; n-octyl decyl dimethyl ammonium chloride in the proportion of 15.0%; di-n-octyl dimethyl ammonium chloride in the proportion of 7.5%; di-n-decyl dimethyl ammonium chloride in the proportion of 7.5%; inert ingredients in the proportion of 50%.

Solutions having increasing concentrations of Quat. A were prepared and the efficacy of the solutions against bacteria and fungi was tested according to the protocols described above. Each test was repeated twice at every concentration level of $H_2O_2$ tested. The results are shown in Table 4, below.

TABLE 4

| Component Quat. A ppm | Anti-Bacterial Activity (% Kill) | Anti-Fungal Activity (% Kill) |
|---|---|---|
| 0 | 0 | 0 |
| 50 | 0, 0 | 0, 0 |
| 100 | 0, 0 | 0, 0 |
| 250 | 0, 10 | 20, 60 |

TABLE 4-continued

| Component Quat. A ppm | Anti-Bacterial Activity (% Kill) | Anti-Fungal Activity (% Kill) |
|---|---|---|
| 500 | 0, 20 | 40, 60 |
| 750 | 20, 30 | 60, 60 |
| 1000 | 25, 35 | 80, 75 |
| 1500 | 30, 35 | 80, 80 |
| 2000 | 40, 40 | 80, 90 |
| 2500 | 60, 40 | 80, 90 |
| 3000 | 75, 40 | 80, 80 |
| 4000 | 85, 70 | 80, 90 |
| 5000 | 90, 90 | 80, 80 |

Solutions of Quat. A alone at all concentrations tested, up to 5000 ppm, failed to achieve kill rates of fungi and bacteria >90%.

Quat B. Alone

A series of tests was conducted according to the above protocols using a preparation comprising the quaternary ammonium compound, didecyl dimethyl ammonium chloride (DDAC), available under the trade name BTC-1010 from the Steppan Company, referred to herein as Quat B. The composition of DDAC is: didecyl dimethyl ammonium chloride in the proportion of 50%; and inert ingredients in the proportion of 50%.

Solutions having increasing concentrations of Quat. B were prepared and efficacy of the solutions against bacteria and fungi was tested according to the above protocols. Each test was repeated twice at every concentration level of Quat. B tested. The results are shown on Table 5, below.

TABLE 5

| Component Quat. B ppm | Anti-Bacterial Activity (% Kill) | Anti-Fungal Activity (% Kill) |
|---|---|---|
| 0 | 0 | 0 |
| 50 | 0, 5 | 0, 10 |
| 100 | 0, 10 | 20, 20 |
| 250 | 0, 15 | 30, 20 |
| 500 | 15, 25 | 50, 30 |
| 750 | 40, 30 | 60, 40 |
| 1000 | 75, 35 | 90, 50 |
| 1500 | 90, 40 | 90, 60 |
| 2000 | 98, 60 | 90, 60 |
| 2500 | 98, 70 | 90, 60 |
| 3000 | 99, 90 | 90, 70 |
| 4000 | 100, 95 | 90, 80 |
| 5000 | 100, 99 | 90, 85 |

Solutions of Quat. B alone provided at least a virtual 100% kill of bacteria when used at concentrations of 2000 ppm or greater. However, the solutions failed to provide a virtual 100% kill of fungi at any of the concentrations tested.

Quat C. Alone

A series of tests was conducted according to the above protocols using a preparation comprising a quaternary ammonium compound mixture available from the Steppan Company under the trademark BTC 2125 M, referred to herein as Quat. C. The active ingredients consisted of: n-alkyl (60% $C_{14}$, 30% $C_{18}$, 5% $C_{12}$, and 5%$C_{18}$) dimethyl benzyl ammonium chloride.

Solutions having increasing concentrations of Quat.C were prepared and efficacy of the solutions against bacteria and fungi were tested according to the protocols described above. The results are shown on Table 6, below.

TABLE 6

| Component Quat. C ppm | Anti-Bacterial Activity (% Kill) | Anti-Fungal Activity (% Kill) |
|---|---|---|
| 0 | 0 | 0 |
| 50 | 0, 0 | 0, 0 |
| 100 | 0, 0 | 0, 10 |
| 250 | 0, 5 | 0, 20 |
| 500 | 15, 20 | 0, 20 |
| 750 | 40, 25 | 0, 20 |
| 1000 | 75, 20 | 15, 20 |
| 1500 | 90, 25 | N/A, 30 |
| 2000 | 98, 30 | 20, 30 |
| 2500 | 98, 30 | 30, 50 |
| 3000 | 99, 30 | 65, 50 |
| 4000 | 100, 30 | 75, 50 |
| 5000 | 100, 40 | 85, 50 |

Solutions of Quat. C alone achieved a virtual 100% kill rate or better on bacteria with concentrations of 2000 ppm or more. However, the same solutions were ineffective in achieving a virtual 100% kill rate for fungi.

Quat.D Alone

A series of tests was conducted using a quaternary ammonium compound comprising n-alkyl dimethyl benzyl ammonium chloride available from the Steppan Company under the trademark BTC 835, hereinafter referred to as Quat.D. Active ingredients in this product are: n-alkyl (50% $C_{14}$, 40% $C_{12}$, 10% $C_{16}$)dimethyl benzyl ammonium chloride in the proportion of 50% and inert ingredients in the proportion of 50%.

Solutions having increasing concentrations of Quat.D were prepared and the efficacy of the solutions against bacteria and fungi was tested according to the protocols described above. Each test was repeated twice at every concentration level of Quat. D tested. The results are shown in Table 7, below.

TABLE 7

| Component Quat. D ppm | Anti-Bacterial Activity (% Kill) | Anti-Fungal Activity (% Kill) |
|---|---|---|
| 0 | 0 | 0 |
| 50 | 0 | 10 |
| 100 | 0 | 20 |
| 250 | 5 | 30 |
| 500 | 10 | 35 |
| 750 | 15 | 50 |
| 1000 | 20 | 50 |
| 1500 | 25 | 70 |
| 2000 | 30 | 80 |
| 2500 | 40 | 80 |
| 3000 | 40 | 80 |
| 4000 | 90 | 95 |
| 5000 | 95 | 95 |

Solutions of Quat. D provided relatively high kill rates of bacteria and fungi only at concentrations of 5000 ppm. But, even at concentrations of 5000 ppm a virtual 100% kill of bacteria and fungi was not achieved.

Peroxide Combined with Surfactant

A series of tests was conducted using a solution comprising $H_2O_2$ in combination with the non-ionic surfactant 201C described above. $H_2O_2$ concentrations of 5%, 15% and 25% were tested three times, each test using different concentrations of the surfactant. The results are shown on Table 8, below.

TABLE 8

| % $H_2O_2$ | % 201C | Anti-Bacterial Activity (% Kill) | Anti-Fungal Activity (% Kill) |
|---|---|---|---|
| 0 | 0 | 0 | 0 |
| 5 | 0 | 100 | 80 |
| 15 | 0 | 100 | 90 |
| 25 | 0 | 100 | 95 |
| 0 | 25 | 20 | 10 |
| 5 | 25 | 100 | 60 |
| 15 | 25 | 100 | 90 |
| 25 | 25 | 100 | 95 |
| 0 | 50 | 50 | 30 |
| 5 | 50 | 100 | 90 |
| 15 | 50 | 100 | 95 |
| 25 | 50 | 100 | 99 |

In the first series of tests test (0 to 25% peroxide), no surfactant was present. As expected, antifungal activity did not reach virtual 100% kill even in the presence of relatively high concentrations of $H_2O_2$ (25%).

In the second series of tests the surfactant was present in concentration levels of 25%. These surfactant concentration levels did not significantly improve antibacterial or antifungal efficacy relative to the first test. That is, a virtual 100% kill of fungi was not achieved.

In the third series of tests a virtual 100% kill of both bacteria and fungi was achieved, but with very high concentrations of peroxide (25%) and surfactant levels of 50%.

Peroxide Combined with Quat. B

In this series of tests $H_2O_2$ concentration levels of 0%, 5%, 15% and 35% were repeatedly tested in combination with increasing levels of Quat. B: 0 ppm, 250 ppm, 500 ppm, 1000 ppm, 2500 ppm and 5000 ppm. The results are shown in Table 9, below.

TABLE 9

| % $H_2O_2$ | QUAT B (ppm) | Anti-Bacterial Activity (% Kill) | Anti-Fungal Activity (% Kill) |
|---|---|---|---|
| 0 | 0 | 0 | 0 |
| 5 | 0 | 100 | 90 |
| 15 | 0 | 100 | 90 |
| 35 | 0 | 100 | 95 |
| 0 | 250 | 20 | 0 |
| 5 | 250 | 80 | 40 |
| 15 | 250 | 100 | 90 |
| 35 | 250 | 100 | 95 |
| 0 | 500 | 25 | 20 |
| 5 | 500 | 100 | 40 |
| 15 | 500 | 100 | 90 |
| 35 | 500 | 100 | 95 |
| 0 | 1000 | 60 | 20 |
| 5 | 1000 | 100 | 80 |
| 15 | 1000 | 100 | 80 |
| 35 | 1000 | 100 | 90 |
| 0 | 2500 | 95 | 60 |
| 5 | 2500 | 100 | 80 |
| 15 | 2500 | 100 | 80 |
| 35 | 2500 | 100 | 90 |
| 0 | 5000 | 100 | 60 |
| 5 | 5000 | 100 | 90 |
| 15 | 5000 | 100 | 80 |
| 35 | 5000 | 100 | 90 |

As the data indicates, solutions of hydrogen peroxide alone and solutions of Quat. B alone, the latter at higher concentrations, were able to achieve in many instances a 100% kill of bacteria. However, neither solutions of hydrogen peroxide and Quat. B alone or combinations of both hydrogen peroxide and Quat. B together were able to provide a virtual 100% kill of fungi.

Surfactant Combined with Quat. B

In this series of tests surfactant (201C) concentrations levels of 0%, 25% and 50% were tested in combination with increasing levels of Quat B: 0 ppm, 250 ppm, 500 ppm, 1000 ppm, 2500 ppm and 5000 ppm. The results are shown on Table 10, below.

TABLE 10

| % 201C | Quat B (ppm) | Anti-Bacterial Activity (% Kill) | Anti-Fungal Activity (% Kill) |
|---|---|---|---|
| 0 | 0 | 0 | 0 |
| 0 | 250 | 20 | 40 |
| 0 | 500 | 20 | 40 |
| 0 | 1000 | 40 | 50 |
| 0 | 2500 | 95 | 80 |
| 0 | 5000 | 95 | 80 |
| 25 | 0 | 0 | 0 |
| 25 | 250 | 20 | 10 |
| 25 | 500 | 20 | 20 |
| 25 | 1000 | 30 | 70 |
| 25 | 2500 | 75 | 95 |
| 25 | 5000 | 90 | 95 |
| 0 | 0 | 15 | 30 |
| 50 | 250 | 20 | 30 |
| 50 | 500 | 20 | 25 |
| 50 | 1000 | 25 | 60 |
| 50 | 2500 | 40 | 80 |
| 50 | 5000 | 100 | 95 |

As the results indicate virtual 100% kill of bacteria did not occur until the highest concentration levels (50% surfactant and 5000 ppm Quat B) were applied. However, even at such levels of surfactant and quaternary ammonium compound a virtual 100% kill of both bacteria and fungi was not achieved.

Peroxide, Surfactant and Quaternary Ammonium Compound Together

In order to demonstrate the performance of the disinfectant cleaning compositions of the instant invention a series of tests was conducted with solutions comprised of the following: surfactant in the proportion of 3.75%; Quat. B in proportions ranging from 500 ppm to 1000 ppm; and $H_2O_2$ solution in proportions ranging from 0% to 3.75%. The mixtures were tested for efficacy against bacteria and fungi according to the protocol described above. The results are shown on Table 11, below.

TABLE 11

| % $H_2O_2$ | % 201C | QUAT B (ppm) | Anti-Bacterial Activity (% Kill) | Anti-Fungal Activity (% Kill) |
|---|---|---|---|---|
| 0 | 3.75 | 500 | 80 | 0 |
| 1 | 3.75 | 500 | 80 | 0 |
| 2 | 3.75 | 500 | 80 | 100 |
| 3 | 3.75 | 500 | 95 | 100 |
| 3.75 | 3.75 | 500 | 95 | 100 |
| 5 | 3.75 | 500 | 100 | 100 |
| 7.5 | 3.75 | 500 | 100 | 100 |
| 10 | 3.75 | 500 | 100 | 100 |
| 3.75 | 3.75 | 0 | 100 | 0 |
| 3.75 | 3.75 | 250 | 100 | 20 |
| 3.75 | 3.75 | 500 | 100 | 80 |
| 3.75 | 3.75 | 750 | 100 | 100 |
| 3.75 | 3.75 | 1000 | 100 | 100 |

The results indicate that virtual 100% kill of both bacteria and fungi was achieved with $H_2O_2$ levels as low as about 3.75%, surfactant levels as low as about 3.75% and Quat. B. levels from as low as about 500 to as low as about 750 ppm.(depending on level of $H_2O_2$)

Conclusion

The test results indicate that the percentage of peroxide required to be present in a disinfectant to achieve at least a virtual 100% kill of both bacteria and fungi can be significantly reduced by combining the peroxide with a surfactant and a quaternary ammonium compound. The test results further indicate the advantageous effect of combining the ingredients according to the present invention to achieve superior kill rates of bacteria and fungi over individual ingredients alone, or in subcombinations of such ingredients.

While the invention has been described in conjunction with various embodiments, they are illustrative only. Accordingly, many alternatives, modifications and variations will be apparent to persons skilled in the art in light of the foregoing detailed description. The foregoing description is intended to embrace all such alternatives and variations falling within the spirit and broad scope of the appended claims.

We claim:

1. A storage stable disinfectant cleaning solution comprising as active ingredients a quaternary ammonium compound; a surfactant, and a hydrogen peroxide solution, said active ingredients being present in minimal proportional ranges sufficient to achieve at least a virtual 100 percent kill of bacteria and fungi present, said solution having a pH in a range of about 6 to 8.

2. The storage stable disinfectant cleaning solution of claim 1, wherein the solution is a working solution comprising from about 0.5 to about 5.0% of the quaternary ammonium compound; from about 0.05 to about 3.5% of the surfactant, and the hydrogen peroxide solution in an amount sufficient to provide a working solution of about 0.05 to about 10% of the hydrogen peroxide.

3. The storage stable disinfectant cleaning solution of claim 1, wherein said quaternary ammonium compound is a tetrasubstituted ammonium salt.

4. The storage stable disinfectant cleaning solution of claim 3, wherein said tetrasubstituted ammonium salt is a quaternary ammonium halide salt.

5. The storage stable disinfectant cleaning solution of claim 4, wherein said quaternary ammonium halide salt is a member selected from the group consisting of a dialkyl dimethyl ammonium chloride, an alkyl dimethyl benzyl ammonium chloride, an alkyl dimethyl ethyl benzyl ammonium chloride and mixtures thereof.

6. The storage stable disinfectant cleaning solution of claim 4, wherein the quaternary ammonium halide salt is didecyl dimethyl ammonium chloride or a N-alkyl dimethyl benzyl ammonium chloride.

7. The storage stable disinfectant cleaning solution of claim 2, wherein said surfactant is a member selected from the group consisting of non-ionic, amphoteric and cationic surfactants other than quaternary ammonium compounds.

8. The storage stable disinfectant cleaning solution of claim 1, wherein said surfactant is a non-ionic surfactant.

9. The storage stable disinfectant cleaning solution of claim 8, wherein said non-ionic surfactant is a polyoxyethylene surfactant.

10. The storage stable disinfectant cleaning solution of claim 8, wherein said non ionic surfactant is a polyalkylene oxide copolymer surfactant.

11. The storage stable disinfectant cleaning solution of claim 2, wherein said surfactant comprises an alkyl phenol ethoxylate.

12. The storage stable disinfectant cleaning solution of claim 2, which is an aqueous solution.

13. The storage stable disinfectant cleaning solution of claim 1, wherein the quaternary ammonium compound is present in an amount of at least about 500 ppm, the surfactant is present in an amount of at least about 0.05%, and the hydrogen peroxide solution is present in an amount sufficient to provide at least 0.05% hydrogen peroxide.

14. The storage stable disinfectant cleaning solution of claim 13, wherein the hydrogen peroxide is present in an amount of at least about 3.75%.

15. The storage stable disinfectant cleaning solution of claim 1 including $H_2O$ in an amount of at least 95% by weight.

16. A storage stable water clear disinfectant cleaning solution comprising as active ingredients a quaternary ammonium compound; a surfactant, and a hydrogen peroxide solution, said active ingredients being present in minimal proportional ranges sufficient to achieve at least a virtual 100 percent kill of bacteria and fungi present, said solution having a pH in a range of about 6 to 8.

17. A method for disinfecting a surface, which comprises the steps of:

(i) providing a disinfectant working solution comprising from about 0.05% to about 5% of a disinfecting quaternary ammonium compound; from about 0.05% to about 3.5% of a detergent composition comprising a surfactant; and a solution of hydrogen peroxide in an amount sufficient to provide the working solution with about 0.05 to about 10% of said hydrogen peroxide and the balance water, said solution having a pH in the range of about 6 to 8, and (ii) contacting a surface with a sterilizing amount of the disinfectant working solution to provide a surface which achieves a virtual 100 percent kill of bacteria and fungi present.

18. The method of claim 17 wherein the surface contacted with the disinfectant working solution is a porous surface.

19. The method of claim 18 wherein the porous surface is a material selected from the group consisting of brick, cinder block, wood, fiberglass and concrete.

20. The method of claim 18 wherein the porous surface is a ceiling tile.

* * * * *